US011459200B2

(12) United States Patent
Dahlqvist et al.

(10) Patent No.: US 11,459,200 B2
(45) Date of Patent: Oct. 4, 2022

(54) SHEET FEEDING DEVICE WITH DYNAMIC FLOAT ADJUSTMENT

(71) Applicant: Plockmatic International AB, Hägersten (SE)

(72) Inventors: Patrik Dahlqvist, Täby (SE); Peter Olofsson, Hägersten (SE)

(73) Assignee: Plockmatic International AB, Hägersten (SE)

( * ) Notice: Subject to any disclaimer, the term of this patent is extended or adjusted under 35 U.S.C. 154(b) by 0 days.

(21) Appl. No.: 17/593,434

(22) PCT Filed: Mar. 20, 2020

(86) PCT No.: PCT/EP2020/057737
§ 371 (c)(1),
(2) Date: Sep. 17, 2021

(87) PCT Pub. No.: WO2020/188073
PCT Pub. Date: Sep. 24, 2020

(65) Prior Publication Data

US 2022/0089394 A1 Mar. 24, 2022

(30) Foreign Application Priority Data

Mar. 20, 2019 (SE) ..... 1950347-3

(51) Int. Cl.
*B65H 7/14* (2006.01)
*B65H 1/14* (2006.01)
(Continued)

(52) U.S. Cl.
CPC ..... *B65H 7/14* (2013.01); *B65H 1/14* (2013.01); *B65H 1/16* (2013.01); *B65H 7/16* (2013.01);
(Continued)

(58) Field of Classification Search
CPC ... B65H 1/08; B65H 1/14; B65H 1/18; B65H 3/48; B65H 7/02; B65H 7/14; B65H 7/16;
(Continued)

(56) References Cited

U.S. PATENT DOCUMENTS 9,061,848 B2 6/2015 Okamoto
9,926,157 B2 3/2018 Sugawara et al.
(Continued)

FOREIGN PATENT DOCUMENTS

WO 2017171627 A1 10/2017

OTHER PUBLICATIONS

International Search Report and Written Opinion for PCT Application No. PCT/EP2020/057737, dated Jul. 16, 2020, 2 pages.
(Continued)

*Primary Examiner* — Prasad V Gokhale
(74) *Attorney, Agent, or Firm* — Brake Hughes Bellermann LLP

(57) ABSTRACT

Method for controlling a sheet feeding device (1) comprising an elevator (2) for a stack of sheets, and an air supply system (3) configured to supply and direct one of more air streams towards an upper region (4) of the sheet feeding device for floating a plurality of upper sheets of the stack of sheets, wherein the elevator comprises a vertically movable support (5) for supporting the stack of sheets from below, wherein the sheet feeding device comprises an optical sensor (6) positioned adjacent the floated sheets for measuring light reflected from the floated sheets at a plurality of different heights, wherein the method comprises the steps of: continuously deriving from the optical sensor a density reading (DR) indicating the density of sheets floated, continuously deriving an average density (AD) based on a plurality of density readings, continuously deriving an upper density
(Continued)

limit (UDL) based on the average density multiplied by a predetermined upper density limit factor (UDLF), continuously deriving a lower density limit (LDL) based on the average density multiplied by a predetermined lower density limit factor (LDLF), adjusting a first operating parameter (OP) of the sheet feeding device should the density reading exceed the upper density limit, wherein the adjustment of the first operating parameter is such as to decrease the density of floated sheets, and adjusting the first operating parameter of the sheet feeding device should the density reading subceed the lower density limit, wherein the adjustment of the first operating parameter is such as to increase the density of floated sheets. Also, a sheet feeding device connected to a controller configured to operate according to this method.

10 Claims, 2 Drawing Sheets

(51) Int. Cl.
*B65H 1/16* (2006.01)
*B65H 7/16* (2006.01)
*B65H 7/20* (2006.01)

(52) U.S. Cl.
CPC ..... *B65H 7/20* (2013.01); *B65H 2553/414* (2013.01); *B65H 2553/416* (2013.01)

(58) Field of Classification Search
CPC ..... B65H 2406/12; B65H 2406/121; B65H 2515/12; B65H 2553/40; B65H 2553/41; B65H 2553/412; B65H 2553/414; B65H 2553/416
See application file for complete search history.

(56) References Cited

U.S. PATENT DOCUMENTS

| | | | | |
|---|---|---|---|---|
| 10,787,329 | B2 * | 9/2020 | Sugawara | B65H 7/14 |
| 2010/0289209 | A1 | 11/2010 | Clark et al. | |
| 2015/0166280 | A1 * | 6/2015 | Hino | B65H 3/14 271/11 |
| 2017/0160689 | A1 * | 6/2017 | Sugawara | B65H 7/14 |
| 2018/0162665 | A1 | 6/2018 | Fukusaka | |
| 2019/0202647 | A1 * | 7/2019 | Sugawara | B65H 7/04 |

OTHER PUBLICATIONS

Office Action and Search Report from Swedish Application No. 1950347-3, dated Oct. 4, 2019, 8 pages.

* cited by examiner

SHEET FEEDING DEVICE WITH DYNAMIC FLOAT ADJUSTMENT

CROSS REFERENCE TO RELATED APPLICATIONS

This application is a 35 U.S.C. § 371 National Phase Entry Application from PCT Application No. PCT/EP2020/057737, filed on Mar. 20, 2020, entitled "SHEET FEEDING DEVICE WITH DYNAMIC FLOAT ADJUSTMENT", and designating the U.S., which claims priority to Swedish Application No. 1950347-3, filed on Mar. 20, 2019, the disclosures of which are incorporated herein in their entireties by reference.

TECHNICAL FIELD

The present disclosure relates to sheet feeding devices for the printing industry, for example sheet feeding devices for printers, copiers or sorters.

BACKGROUND

Sheet feeding devices are commonly integrated into printers or copiers and are manually loaded with a large number of sheets in order to automatically provide sheets, one by one, for a subsequent operation on the sheet, such as printing or sorting.

One example of a prior art sheet feeding device by the present applicant is described in the international patent application number PCT/SE2017/050323. Disclosed is a paper feeding device comprising a storage surface for a stack of papers, with a leading edge, a trailing edge, and a first and a second side edge. The surface is adapted to be moved vertically. The device further comprises a vacuum belt feeder for feeding papers from their position on the storage surface and imparting on an uppermost sheet of paper a horizontal displacement, and a blower arrangement adapted to provide a curtain of air separating the uppermost sheet of paper from the rest of the stack of papers. The device further comprises a sensor arrangement arranged to determine where the upper paper sheets in the stack of papers start to separate from the rest of the paper sheets, the sensor arrangement comprising a plurality of infrared reflective sensors.

A challenge for sheet feeding devices is to manage sheets of various materials and qualities whilst minimizing or eliminating problems associated with double-feed, sheet jam or manual configuration and adjustment for operating the sheet feeding device with different sheet sized and qualities.

SUMMARY

Accordingly, the present disclosure aims to mitigate the above mentioned drawbacks singly or in combination by providing a method of operating a sheet feeding device comprising an elevator for a stack of sheets, and an air supply system configured to supply and direct one of more air streams towards an upper region of the sheet feeding device for floating a plurality of upper sheets of the stack of sheets, wherein the elevator comprises a vertically movable support for supporting the stack of sheets from below, and wherein the sheet feeding device comprises an optical sensor positioned adjacent the floated sheets for measuring light reflected from the floated sheets at a plurality of different heights.

The sheet feeding device is normally used before a printer, copier or other paper handling machine to supply individual sheets one by one to the printer/copier/paper handling machine. To enable this, a stack of sheets is loaded onto the elevator with the side support members positioned to define a space corresponding to the width of the stack of sheets such that the side support members sideways support the respective opposite sides of the stack of sheets. The elevator then moves the uppermost sheet of the stack of sheets upwards or downwards until it is at a suitable height in the upper region. The air supply system is used to supply and direct an air stream towards the upper region and thereby float a plurality of upper sheets of the stack of sheets such that they are separated and suspended in the air stream. When being floated by the air stream, the uppermost sheets are sequentially transported upwards from the stack of sheets by the floating air towards the vacuum belt feeder as sheets are removed from the top of the floated sheets. The vacuum belt feeder provides a vacuum through its perforated belt which forces the uppermost of the floated sheets to be held to the belt such that the belt can then transport it away from the floated sheets and out of the sheet feeding device for further processing.

The method of controlling the sheet feeding device comprises the steps of: continuously deriving from the optical sensor a density reading indicating the density of sheets floated, continuously deriving an average density based on a plurality of density readings, continuously deriving an upper density limit based on the average density multiplied by a predetermined upper density limit factor, continuously deriving a lower density limit based on the average density multiplied by a predetermined lower density limit factor, adjusting a first operating parameter of the sheet feeding device should the density reading exceed the upper density limit, wherein the adjustment of the first operating parameter is such as to decrease the density of floated sheets, and adjusting the first operating parameter of the sheet feeding device should the density reading subceed the lower density limit, wherein the adjustment of the first operating parameter is such as to increase the density of floated sheets.

Upon operation of the sheet feeding device, a stack of sheets is positioned in the elevator. The uppermost sheets are floated using the air supply system and the density of floated sheets is continuously measured using the optical sensor. The floated sheets tend to move around whilst being floated and therefore the density measurement will give a varying reading. An average value is derived based on a plurality of density readings and then the upper and lower density limits are derived by using the average value multiplied by upper and lower density limit factors respectively. The sheet feeding device is then operated to increase or decrease density of floated papers as needed based on a comparison of the current density reading to the upper and lower density limits derived from the average density. For example, a too high density reading may be used to trigger lowering of the vertically movable support and a too high density reading may be used to trigger raising of the vertically movable support.

Thus, the sheet feeding device dynamically adapts its operating parameter to achieve a more stable density of floated sheets. This method allows the sheet feeding device to handle sheets of varying weights and types under varying operating conditions automatically whereas prior art solutions rely on fixed ranges based on manual settings for each paper quality. The adjustment of the operating parameter after a while affects the density of sheets floated such that the density increases or decreases, which in turn causes the average density to change, thereby chasing a stable condition suitable for the quality of sheets used and the current operating condition, such as humidity level, affecting current sheet curl, etc.

The first operating parameter may be the height of the vertically movable support surface. Raising the vertically movable support tends to increase density of floated sheets, whereas lowering of the vertically movable support tends to lower density of floated sheets. Thus, the height of the vertically movable support is lowered should the density reading exceed the upper density limit. Further, the height of the vertically movable support is raised should the density reading subceed the lower density limit.

The first operating parameter may be the air speed of the air supply system. The air speed of the air supply system can be used to affect the density of sheets floated. Specifically, a higher air speed may lead to more floated sheets whilst a lower air speed may lead to fewer floated sheets. However, too high air speed will cause sheets to be pressed together upwards, i.e. not separated, whilst too low air speed will cause the sheets not to float. Thus, the air speed is lowered should the density reading exceed the upper density limit. Further, the air speed is increased should the density reading subceed the lower density limit.

The optical sensor may comprise an array of vertically distributed photovoltaic sensors. The photovoltaic sensors provide a low cost means for measuring light intensity and the array of such sensors enables measuring of light intensity along the vertical extent of the floated sheets. However, the spacing of the photovoltaic sensors is relatively large compared to the typical thickness of sheets processed, and thus the sensors do not provide a detailed view of sheets floated and thus only a rough measurement of density. However, together with the proposed method steps, the automatic adjustment of the operating parameters based on density readings works well.

The optical sensor may further comprise vertically distributed light emitting diodes arranged so as to emit light towards the stack of sheets or floated sheets such that light reflected by sheets is detectable by the photovoltaic sensors. The use of light emitting diodes enables controlled lighting of the region of floated papers to be studied by the sensor and thus yields more predictable results than when relying on ambient lighting.

The average density may be based on 15-25 seconds of readings from the optical sensor, preferably 20 seconds.

The density reading may be performed at least 30 times per second, preferably at least 50 times per second, such as 50-60 times per second.

The upper parameter may be within the range of 1.05 to 1.15, such as between 1.09 and 1.11, or the upper parameter may be 1.1.

The lower parameter may be within the range of 1/1.05 to 1/1.15, such as between 1/11 and 1/1.09, or 1/1.10 or the lower parameter may be 1/1.1.

The present disclosure also relates to a sheet feeding device comprising an elevator for a stack of sheets, and an air supply system configured to supply and direct one of more air streams towards an upper region of the sheet feeding device for floating a plurality of upper sheets of the stack of sheets, wherein the elevator comprises a vertically movable support for supporting the stack of sheets from below, wherein the sheet feeding device comprises an optical sensor positioned adjacent the floated sheets for measuring light reflected from the floated sheets at a plurality of different heights, and wherein the sheet feeding device is connected to a controller configured to operate according to the above disclosed method of operating such a sheet feeding device.

Figure 1:
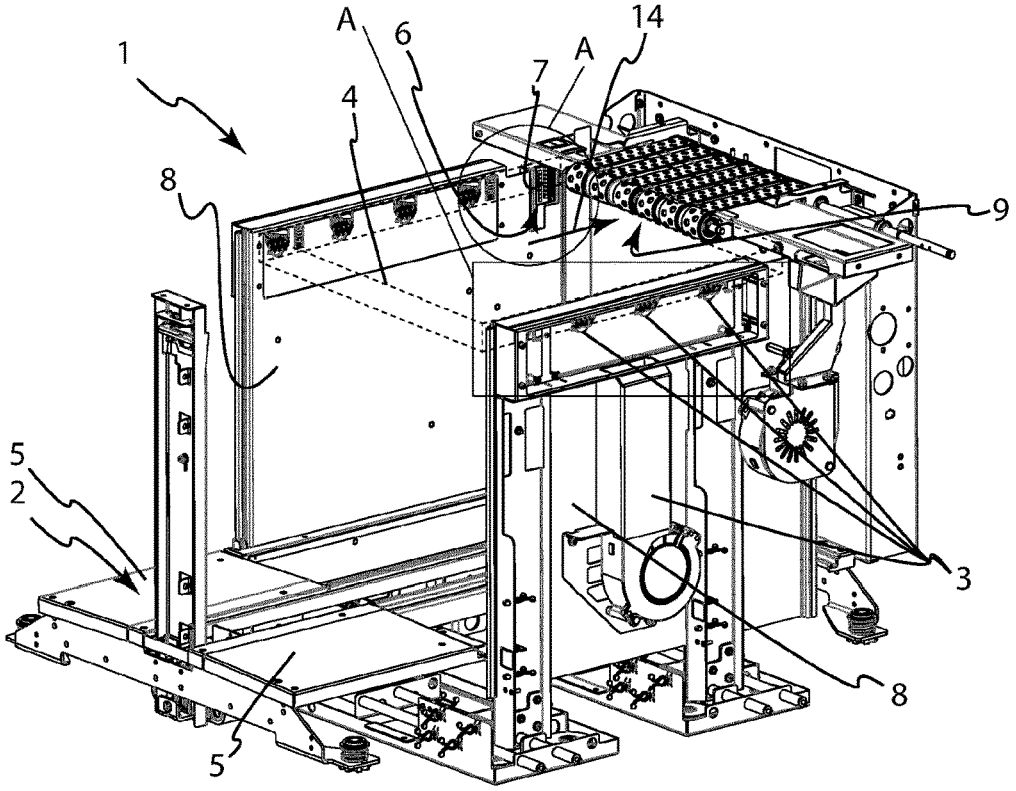
FIG. 1 shows a perspective view of a sheet feeding device according to a first embodiment.
Figure 2:
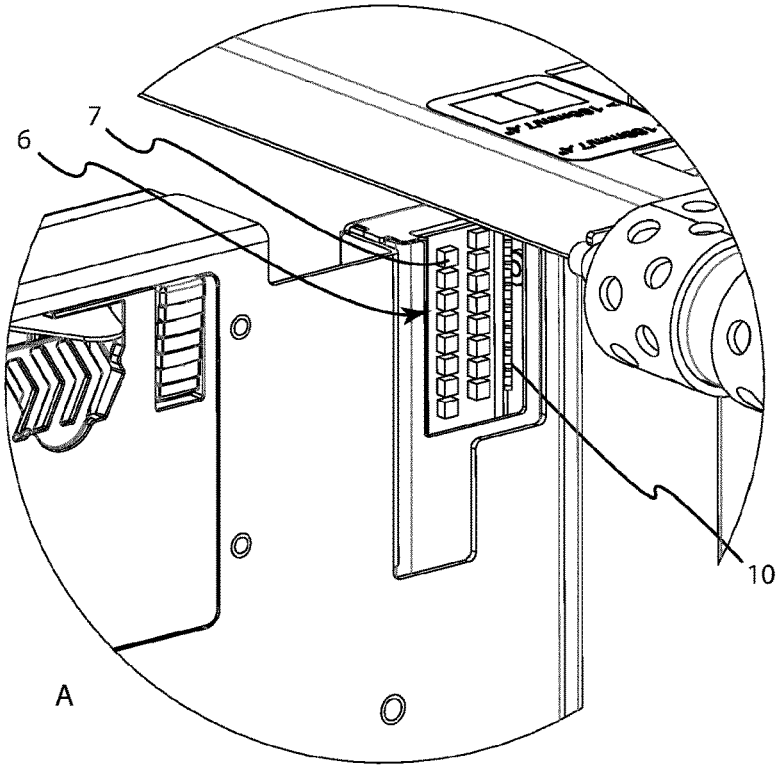
FIG. 2 shows detail view A with the optical sensor.
Figure 3:
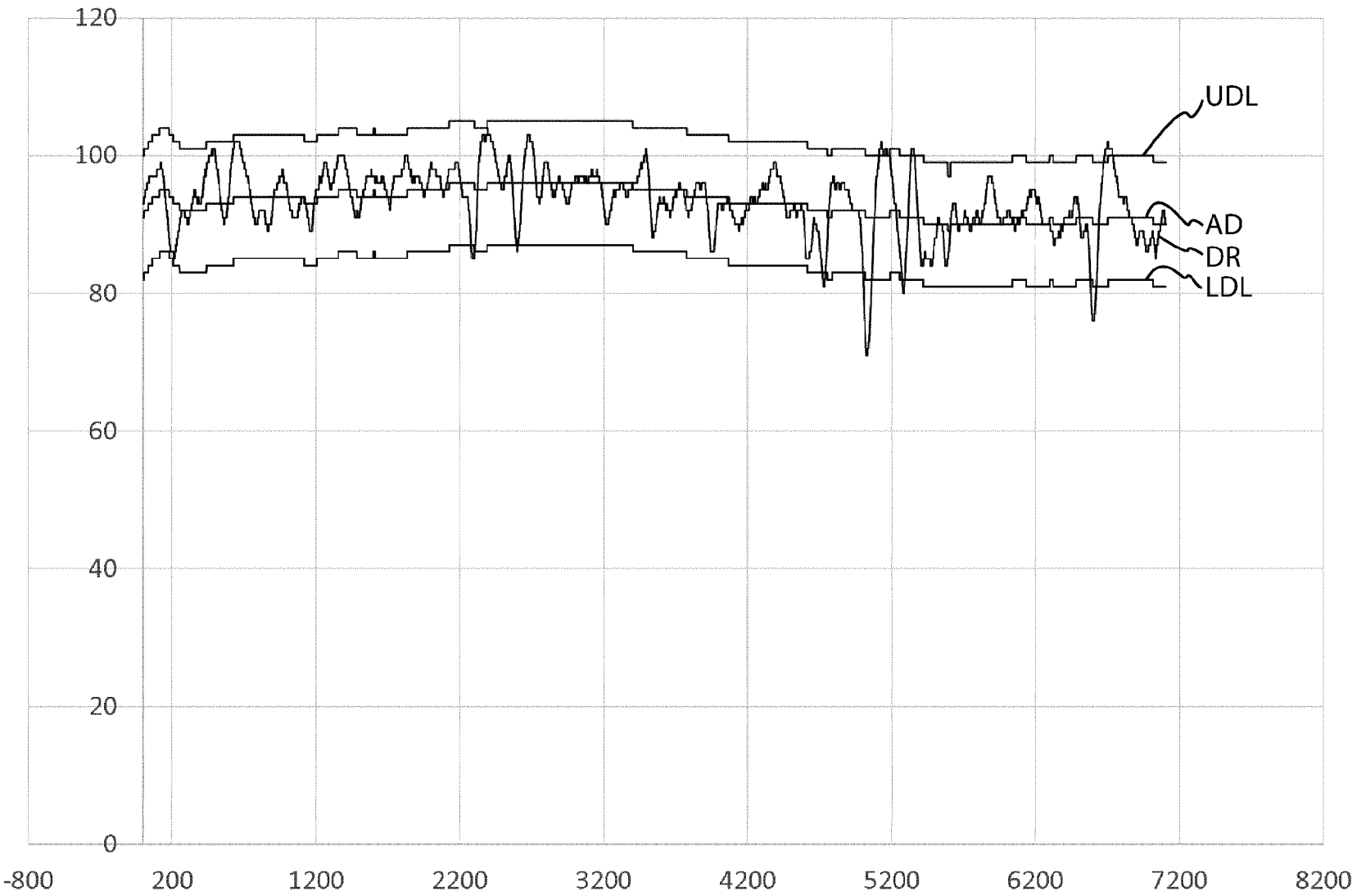
FIG. 3 shows a graph of density reading, average density, and derived upper and lower density limits.

| | | | |
|---|---|---|---|
| 1 | sheet feeding device | 9 | vacuum belt feeder |
| 2 | elevator | 10 | light emitting diodes |
| 3 | air supply system | DR | density reading |
| 4 | upper region | AD | average density |
| 5 | vertically movable support | UDL | upper density limit |
| 6 | optical sensor | UDLF | upper density limit factor |
| 7 | array of photovoltaic sensors | LDL | lower density limit |
| 8 | side support members | LDLF | lower density limit factor |
| | | OP | first operating parameter |

DETAILED DESCRIPTION

A first embodiment of the inventive sheet feeding device 1 will hereinafter be described with reference to the appended drawings.

As mentioned above, the sheet feeding device 1 is normally used before a printer, copier or other paper handling machine to supply individual sheets one by one to the printer/copier/paper handling machine. To enable this, a stack of sheets is loaded onto the elevator 2. The sheet feeding machine 1 is provided with side support members 8 positioned to define a space corresponding to the width of the stack of sheets such that the side support members 8 sideways support the respective opposite sides of the stack of sheets. The elevator 2 then moves the uppermost sheet of the stack of sheets upwards or downwards by raising or lowering the vertically movable support 2 until the uppermost sheet is at a suitable height in an upper region 4 of the sheet feeding device 1. The air supply system 2 is used to supply and direct an air stream towards the upper region 4 and thereby float a plurality of upper sheets of the stack of sheets such that they are separated and suspended in the air stream. When being floated by the air stream, the uppermost sheets are sequentially transported upwards from the stack of sheets by the floating air towards a vacuum belt feeder 9 as sheets are removed from the top of the floated sheets. The vacuum belt feeder 9 provides a vacuum through its perforated belt which forces the uppermost of the floated sheets to be held to the belt such that the belt can transport the sheet away from the floated sheets and out of the sheet feeding device 1 for further processing.

The sheet feeding device 1 comprises a controller (not illustrated) configured at least to control the vertical position of the vertically movable support 5, to control the air supply system 3 and to control the vacuum belt feeder 9. The controller operates the vertically movable support 5 to account for sheets fed out of the sheet feeding device 1 and thereby maintain a proper number of sheets floated. A too high height of the vertically movable support 5 will typically lead to non-separated sheets and a too low height of the vertically movable support 5 will typically eventually lead to a lack of sheets for the vacuum belt feeder 9 to grab. The controller also operates the air supply system 3 to provide proper floating with good separation of sheets floated. Further, the controller operates the vacuum belt feeder 9 to grab the uppermost sheet floated and move it away to be fed out of the sheet feeding device 1. The controller may be implemented in one or in several control units and the control units could be integrated with the sheet feeding device 1 or provided separately from the sheets feeding device 1 but connected to the sheet feeding device 1 such that they can communicate.

However, it should be understood that control of the floating process is not trivial. In order to control the height of the vertically movable support 5, the present invention uses information from an optical sensor 6 to control the height of the vertically movable support 5. In other embodiments, the information from the optical sensor 6 could also be used to control the fan speed of the air supply system 3 and/or the vacuum belt 9.

In this embodiment, the optical sensor 6 comprises a of vertically distributed light sensors such as photovoltaic sensors. The light sensors are aligned in two vertical rows which rows are vertically offset such that the light sensors' vertical positions overlap between the two rows thereby giving an increased vertical resolution as compared to using only one row of light sensors. Such a sensor is further described in PCT/SE2017/050323. The light sensors are of a type sensitive for infrared light, such that visible light will not interfere with the light measurements. However, in other embodiments the light sensors may be designed for measuring other wavelengths. An advantage of these sensors are that they are inexpensive and reliable. However, the vertically distributed light sensors are relatively large, quite few in number and are spaced apart, which causes them to provide a relatively low-resolution information for the controller to work with. Hence, such an optical sensor it is not reliable for detecting the position of individual sheets. The optical sensor also comprises vertically distributed light emitting diodes (LEDs) arranged so as to emit light towards the stack of sheets and/or floated sheets such that light reflected by sheets is detectable by the light sensors. The LEDs are infrared LEDs but could in other embodiments be omitted or be of other types as long as they are adapted to the wavelength of the light sensor. The use of light emitting diodes enables controlled lighting of the region of floated papers to be studied by the sensor and thus yields more predictable results than when relying on ambient lighting.

The invention specifically teaches the use of a new method of using the optical sensor 6 for of the sheet feeding device 1 for controlling an operating parameter OP the sheet feeding device 1 such that the sheet feeding device 1 reliably feeds single sheets. The operating parameter OP could be the height position of the vertically movable support 5 but it could alternatively be air speed or some other parameter controlling the density of floated sheets. Specifically, the method makes use of density measurement of floated sheets for automatically controlling the height position of the vertically movable support 5. It should be understood that the 'density' of sheets floated is not the physical density of each sheet but rather how many sheets are floated in the floating region above the stack of non-floated sheets. By studying the amount of light reflected by sheets floated, a measure of the density/number of sheets floated is established. The floated sheets do not have static positions suspended in air, but tend to move around, which leads to variations in the light reflected by the sheets. The controller of the sheet feeding device 1 is configured to operate the sheet feeding device 1 according to the inventive method comprising: continuously deriving from the optical sensor 6 a density reading DR indicating the density of sheets floated, continuously deriving an average density AD based on a plurality of density readings, continuously deriving an upper density limit UDL based on the average density AD multiplied by a predetermined upper density limit factor UDLF, continuously deriving a lower density limit LDL based on the average density AD multiplied by a predetermined lower density limit factor LDLF, decreasing the height position of the vertically movable support 5 should the density reading DR exceed the upper density limit UDL, thereby decreasing the density of floated sheets, and increasing the height position of the vertically movable support 5 should the density reading DR subceed the lower density limit LDL, thereby increasing the density of floated sheets. In other embodiments, the air speed may additionally or alternatively be adjusted in addition to/as an alternative to the height position adjustment of the vertically movable support 5.

Thus, the sheet feeding device 1 dynamically adapts its operating parameter to achieve a more stable density of floated sheets. This method allows the sheet feeding device 1 to handle sheets of varying weights and types under varying operating conditions automatically whereas prior art solutions rely on fixed ranges based on manual settings for each paper quality. The adjustment of the operating parameter after a while affects the density of sheets floated such that the density increases or decreases, which in turn causes the average density to change, thereby chasing a stable condition suitable for the quality of sheets used and the current operating condition, such as humidity level, affecting current sheet curl, etc.

Raising the vertically movable support 5 tends to increase density of floated sheets, whereas lowering of the vertically movable support 5 tends to lower density of floated sheets. Thus, the height of the vertically movable support 5 is lowered should the density reading exceed the upper density limit UDL. Further, the height of the vertically movable support 5 is raised should the density reading subceed the lower density limit LDL.

The air speed of the air supply system 3 can be used to affect the density of sheets floated. Specifically, a higher air speed may lead to more floated sheets whilst a lower air speed may lead to fewer floated sheets. However, too high air speed will cause sheets to be pressed together upwards, i.e. not separated, whilst too low air speed will cause the sheets not to float. Thus, the air speed may in some embodiments be lowered should the density reading exceed the upper density limit UDL. Further, the air speed may in some embodiments be increased should the density reading subceed the lower density limit LDL.

The optical sensor 6 comprises an array 7 of vertically distributed photovoltaic sensors. The photovoltaic sensors provide a low cost means for measuring light intensity and the array 7 of such sensors enables measuring of light intensity along the vertical extent of the floated sheets. However, the spacing of the photovoltaic sensors is relatively large compared to the typical thickness of sheets processed, and thus the sensors do not provide a detailed view of sheets floated and thus only a rough measurement of density. However, together with the proposed method steps, the automatic adjustment of the operating parameters OP based on density readings works well.

The optical sensor 6 further comprises vertically distributed light emitting diodes arranged so as to emit light towards the stack of sheets or floated sheets such that light reflected by sheets is detectable by the photovoltaic sensors. The use of light emitting diodes enables controlled lighting of the region of floated papers to be studied by the sensor and thus yields more predictable results than when relying on ambient lighting.

The average density is based on 20 seconds of readings but may in other embodiments alternatively be based on 15-25 seconds of readings from the optical sensor.

The density reading is made 50 times per second but may in other embodiments alternatively be made at least 30 times per second, preferably at least 50 times per second, such as 50-60 times per second.

The upper parameter is 1.1 but may in other embodiment alternatively be within the range of 1.05 to 1.15, such as between 1.09 and 1.11.

The lower parameter is 1/1.1, but may in other embodiments alternatively be within the range of 1/1.05 to 1/1.15, such as between 1/11 and 1/1.09, or 1/1.10.

The invention claimed is:

1. A method of operating a sheet feeding device, said device comprising an elevator for a stack of sheets; and an air supply system configured to supply and direct one of more air streams towards an upper region of the sheet feeding device for floating a plurality of upper sheets of the stack of sheets, wherein the elevator comprises a vertically movable support for supporting the stack of sheets from below, wherein the sheet feeding device comprises an optical sensor positioned adjacent the floated sheets for measuring light reflected from the floated sheets at a plurality of different heights, wherein the method comprises the steps of:

continuously deriving from the optical sensor a density reading (DR) indicating the density of sheets floated, continuously deriving an average (AD) density based on a plurality of density readings, continuously deriving an upper density limit (UDL) based on the average density (AD) multiplied by a predetermined upper density limit factor (UDLF), continuously deriving a lower density limit (LDL) based on the average density multiplied by a predetermined lower density limit factor (LDLF), adjusting a first operating parameter (OP) of the sheet feeding device should the density reading (DR) exceed the upper density limit (UDL), wherein the adjustment of the first operating parameter (OP) is such as to decrease the density of floated sheets, and adjusting the first operating parameter (OP) of the sheet feeding device should the density reading (DR) sub-ceed the lower density limit (LDL), wherein the adjustment of the first operating parameter (OP) is such as to increase the density of floated sheets.

2. The method according to claim 1, wherein the first operating parameter (OP) is the height of a surface of the vertically movable support.

3. The method according to claim 1, wherein the first operating parameter (OP) is an air speed of the air supply system.

4. The method according to claim 1, wherein the optical sensor comprises an array of vertically distributed photovoltaic sensors.

5. The method according to claim 4, wherein the optical sensor further comprises vertically distributed light emitting diodes arranged so as to emit light towards the stack of sheets and/or floated sheets such that light reflected by sheets is detectable by the photovoltaic sensors.

6. The method according to claim 1, wherein the average density (AD) is based on 3-5 seconds of readings from the optical sensor.

7. The method according to claim 1, wherein the density reading (DR) is performed at least 30 times per second, preferably at least 50 times per second, such as 50-60 times per second.

8. The method according to claim 1, wherein the upper density limit factor (UDLF) is within a range of 1.05 to 1.15, such as between 1.09 and 1.11, or the upper density limit factor may be 1.1.

9. The method according to claim 1, the lower density limit factor is within a range of 1/1.05 to 1/1.15, such as between 1/11 and 1/1.09, or 1/1.10 or the lower density limit factor may be 1/1.1.

10. A sheet feeding device comprising:

an elevator for a stack of sheets; and an air supply system configured to supply and direct one of more air streams towards an upper region of the sheet feeding device for floating a plurality of upper sheets of the stack of sheets, wherein the elevator comprises a vertically movable support for supporting the stack of sheets from below, wherein the sheet feeding device comprises an optical sensor positioned adjacent the floated sheets for measuring light reflected from the floated sheets at a plurality of different heights, and wherein the sheet feeding device is connected to a controller configured to operate according to the method of claim 1.

* * * * *